US005487230A

United States Patent [19]

Weyer

[11] Patent Number: 5,487,230

[45] Date of Patent: Jan. 30, 1996

[54] TOOL ACTUATOR WITH ADJUSTABLE ATTACHMENT MOUNT

[76] Inventor: Dean R. Weyer, 707 Victor, Enumclaw, Wash. 98022

[21] Appl. No.: 355,593

[22] Filed: Dec. 14, 1994

[51] Int. Cl.[6] ..... E02F 3/36

[52] U.S. Cl. ..... 37/468; 414/723; 37/403

[58] Field of Search ..... 37/460, 443, 403; 414/694, 705, 723, 724; 403/110, 150, 154

[56] References Cited

U.S. PATENT DOCUMENTS

| | | | |
|---|---|---|---|
| 2,620,200 | 12/1952 | Anderson | 403/154 X |
| 4,397,604 | 8/1983 | McCain | 414/705 X |
| 4,779,364 | 10/1988 | Holmdal | 37/468 X |
| 4,906,161 | 3/1990 | Weyer | 414/705 |
| 5,145,313 | 9/1992 | Weyer | 414/723 |
| 5,242,258 | 9/1993 | Weyer | 414/723 |

*Primary Examiner*—Randolph A. Reese
*Assistant Examiner*—Thomas A. Beach
*Attorney, Agent, or Firm*—George C. Rondeau, Jr.; Seed and Berry

[57] ABSTRACT

A fluid-powered, laterally tiltable tool actuator. A tool has a pair of clevises, and an actuator has a generally cylindrical body with an output shaft rotatably disposed therein with an axis in general parallel alignment with a forward rotation plane through which the tool is rotatable on a backhoe arm by the operation of a rotation link. A bracket is attached to the body and has a pair of clevises for pivotal attachment to the vehicle arm and rotation link. The output shaft has a pair of shaft attachment members at each end for attaching the shaft to the corresponding tool clevises. The first pair of shaft attachment members is rigidly fixed to the shaft and attached to a first tool clevis. The second pair of shaft attachment members is pivotally attached to the shaft and pivots in a plane generally parallel to the longitudinal axis of the shaft. The pivoting attachment members can be adjustably positioned to accommodate various distances which separate the first and second tool clevises of different tools to allow the pivoting attachment members to be readily attached to a second tool clevis. A linear-to-rotary transmission device disposed within the body produces rotational movement of the shaft relative to the body to produce lateral tilting of the tool in a lateral plane generally transverse to the forward rotational plane.

16 Claims, 7 Drawing Sheets

TOOL ACTUATOR WITH ADJUSTABLE ATTACHMENT MOUNT

TECHNICAL FIELD

The present invention relates generally to backhoes and excavators and, more particularly, to buckets and other tools which are laterally tiltable.

BACKGROUND OF THE INVENTION

Backhoes, excavators and similar type vehicles have an extendable or articulated arm with a tool such as a bucket or hydraulic breaker attached at an end thereof remote from the operator. Generally, a rotation link is associated with the arm. The tool is pivotally attached to the arm by a clevis which serves as a pivot point for the tool. The rotation link is also pivotally attached to the tool so that movement of the rotation link causes the tool to rotate about the arm pivot point. With such an arrangement, the tool can be rotated relative to the arm in a generally vertical, forwardly extending plane defined by the arm and the rotation link, but lateral tilting of the-tool is not possible, at least without tilting of the vehicle. The arm and rotation link are usually not laterally tiltable relative to the vehicle to which they are attached.

There are occasions, however, when it would be very desirable to work with the tool or other tool tilted to the left or right, such as when necessary to adjust for slope requirements or to do side-angle grading. It is, of course, undesirable and often not possible to laterally tilt the entire vehicle to achieve tilting of the tool.

This problem has been overcome with the advent of laterally tiltable tool actuators such as shown in U.S. Pat. Nos. 4,906,161; 5,145,313 and 5,242,258. Such tool actuators generally include a helical actuator attached to the arm and the rotation link, and supporting a tool or other tool for lateral rotation thereof. This allows the tool to be laterally tilted from side to side. Control of the amount of lateral tilting is accomplished by selective application of fluid pressure within the actuator. Such tool actuators can transmit large torque to the tool and firmly hold the tool at the desired tilt angle.

The tool generally has spaced apart mounting holes at a fixed separation to allow the tool to be mounted to the arm. The arm has mating holes which are spaced apart by the same distance to allow the tool to be attached thereto with mounting pins. The tool actuators mentioned above have the actuator connectable to the tool using these same mounting holes. While they do provide some ability to operate with tools with varying mounting hole spacings, the designs do not provide for sufficient flexibility in the size of mounting hole spacings encountered. Further, they are not as quick and easy to use as desired and are more complicated in design and expensive to manufacture than desired.

It will, therefore, be appreciated that there has been a significant need for a laterally tiltable tool actuator which can easily be adapted to fit tools and other tools of varying mounting hole spacings. The present invention fulfills this need and further provides other related advantages.

SUMMARY OF THE INVENTION

The present invention resides in a fluid-powered tool actuator, usable with a vehicle having an arm and a rotation link associated therewith for rotation of the tool actuator in a first plane defined by movement of the rotation link relative to the arm. The arm and the rotation link each has an attachment member located toward a free end thereof. The actuator is usable with a plurality of tools, each having a first tool attachment member and a second tool attachment member located away from the first tool attachment member where the distance between the first and second tool attachment members varies from tool to tool within a range of tool attachment member distances. The first and second tool attachment members are arranged in general parallel alignment with the first plane. In one embodiment of the invention, the tool is a tool and the invention is in the form of a fluid-powered laterally tiltable tool assembly.

The tool actuator comprises a body having a longitudinal axis and first and second ends. An attachment bracket is rigidly attached to the body and has an external first bracket attachment member located generally along the body axis for pivotal attachment of the vehicle arm by the vehicle arm attachment member and an external second bracket attachment member located generally along the body axis away from the first bracket attachment member for pivotal attachment of the rotation link by the rotation link attachment member. The first and second bracket attachment members are selectively detachable from the arm and rotation link attachment members. When the arm and rotation link attachment members are attached to the attachment bracket, movement of the rotation link causes the body to rotate about the vehicle arm with movement of the longitudinal axis of the body in general parallel alignment with the first plane. The tool actuator is selectively detachable from the vehicle arm and the rotation link.

The tool actuator further includes an output shaft rotatably disposed within the body in general coaxial arrangement with the body. The shaft has a first shaft end portion extending at least to the first body end and a second shaft end portion extending toward the second body end. The first shaft end portion has a first shaft attachment member attached thereto which is releasably attachable to the first tool attachment member.

The tool actuator also includes a member pivotally attached to the second shaft end portion to pivot about an axis generally transverse to the second shaft end portion. The pivotable member has a second shaft attachment member attached thereto which is releasably attachable to the second tool attachment member. The pivotable member is selectively pivotable to move the second shaft attachment member within a range of distances corresponding to the range of tool attachment member distances and position the second shaft attachment member at a selected distance from the first shaft attachment member such that the first and second attachment members are spaced apart by the same distance as the first and second tool attachment members for the tool being attached to the shaft. The first and second shaft attachment members releasably attach the tool to the shaft for rotation with the shaft through a second plane extending laterally, generally transverse to the first plane.

The tool actuator also includes a linear-to-rotary torque transmitting member mounted for longitudinal movement within the body in response to selective application of pressurized fluid thereto. The torque-transmitting member engages the body and the shaft to translate longitudinal movement of the torque-transmitting member into rotational movement of the shaft relative to the body. In such manner, the tool attached to the shaft is rotatable in the first plane and laterally tiltable in the second plane.

In the preferred embodiment of the invention, the second shaft attachment member includes a pair of laterally spaced apart swing arms, each with a first end portion pivotally attached at the second shaft end portion and a second end portion forming a part of the second shaft attachment member.

Other features and advantages of the invention will become apparent from the following detailed description, taken in conjunction with the accompanying drawings.

DETAILED DESCRIPTION OF THE INVENTION

Figure 1:
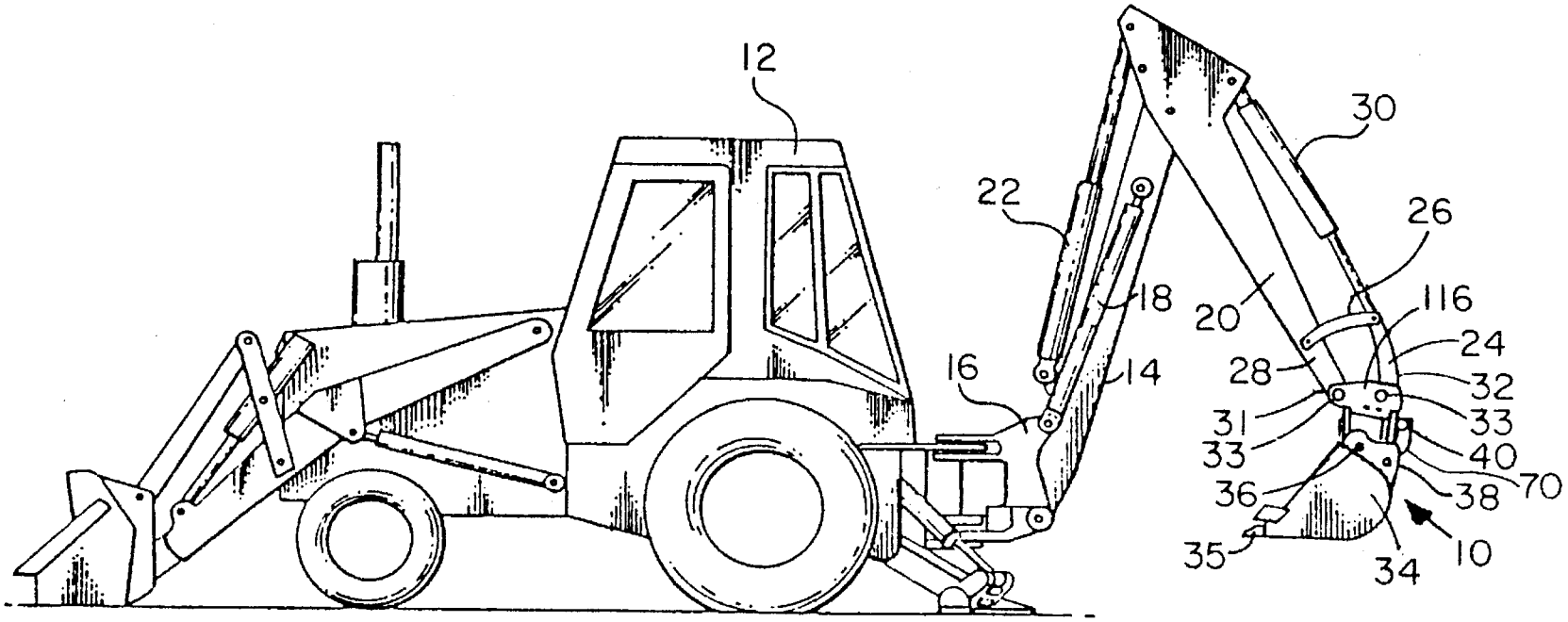
FIG. 1 is a left side elevational view of a backhoe shown with a laterally tiltable tool assembly having an adjustable attachment mount embodying the present invention and having a bucket attached.

As shown in the drawings for purposes of illustration, the present invention is embodied in a fluid-powered, laterally tiltable tool assembly, indicated generally by reference numeral 10. As shown in FIG. 1, the tool assembly 10 is usable with a vehicle 12, such as the illustrated backhoe or any excavator or other vehicle that might use a tool or other tool as a work implement. The vehicle 12 has a first arm 14 which is pivotally connected by one end to a base member 16. A pair of hydraulic cylinders 18 (only one being shown in FIG. 1) is provided for raising and lowering the first arm in a generally forwardly extending vertical plane with respect to the base member 16. A second arm 20 is pivotally connected by one end to an end of the first arm 14 remote from the base member 16. A hydraulic cylinder 22 is provided for rotation of the second arm 20 relative to the first arm 14 in the same vertical forward rotation plane as the first arm operates.

The base member 16 is pivotally attached to the vehicle 12 for pivotal movement about a vertical axis so as to permit movement of the first and second arms 14 and 20 in unison to the left or right, with the first and second arms always being maintained in the forward rotation plane. It is noted that while the forward rotation plane is referred to as being forwardly extending for convenience of description, as the base member 16 is pivoted the forward rotation plane turns about the vertical pivot axis of the base member and thus to a certain extent loses its forward-to-rearward orientation, with the plane actually extending laterally should the base member be sufficiently rotated.

A rotation link 24 is pivotally connected through an interconnecting link 26 to an end portion 28 of the second arm 20 remote from the point of attachment of the second arm to the first arm 14. A hydraulic cylinder 30 is provided for selective movement of the rotation link 24 relative to the second arm 20.

As is conventional, a free end portion 31 of the second arm 20 and a free end portion 32 of the rotation link 24 each has a transverse aperture therethrough for connection of the second arm and the rotation link to a conventional tool using a pair of selectively removable attachment pins 33. The attachment pins 33 are insertable in the apertures to pivotally connect the conventional tool to the second arm and the rotation link. When using the conventional tool, this permits the tool to be rotated about the attachment pin 33 of the second arm 20 upon movement of the rotation link 24 relative to the second arm as a result of extension or retraction of the hydraulic cylinder 30 to rotate the tool in the forward rotation plane defined by the first and second arms 14 and 20.

Figure 2:
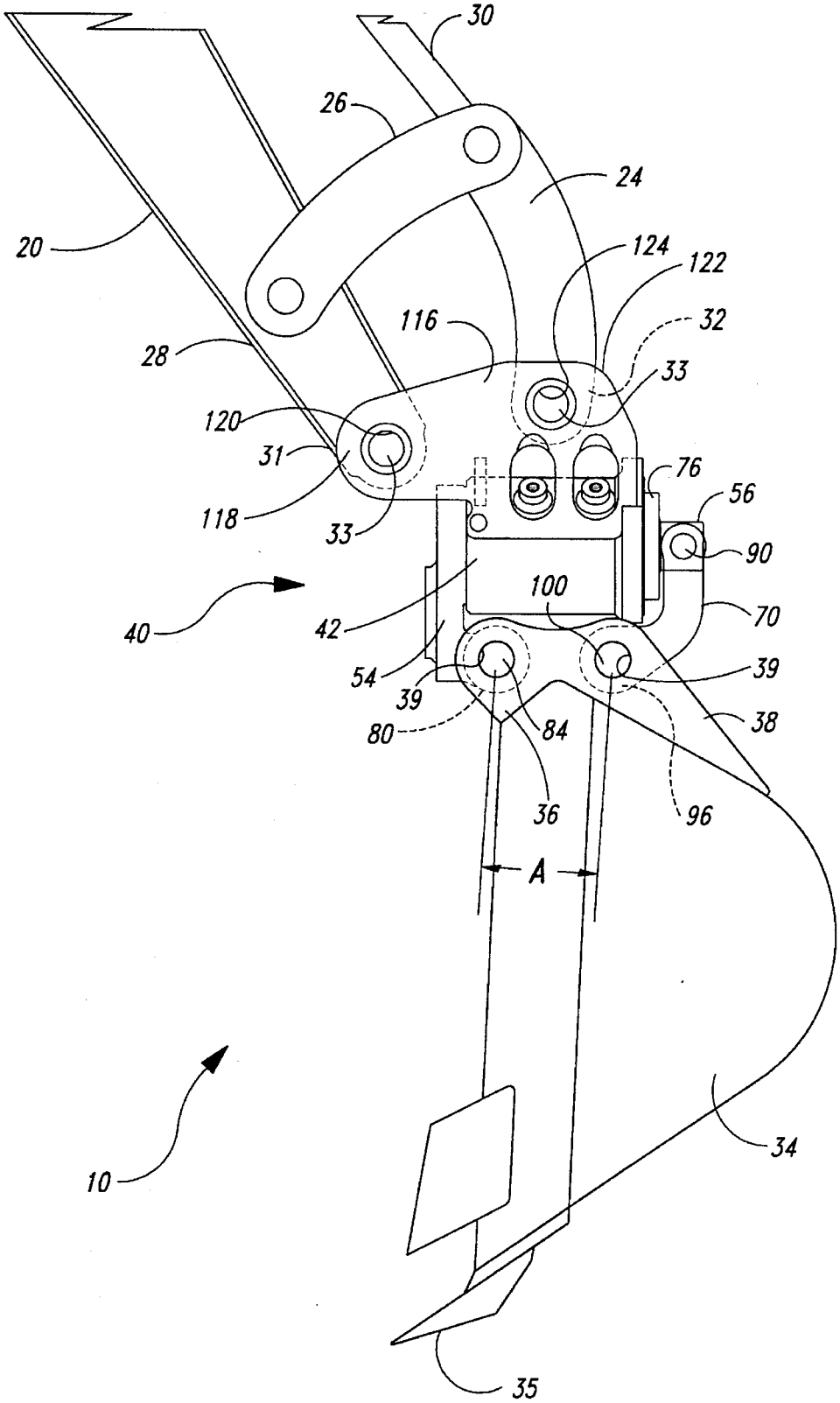
FIG. 2 is an enlarged, fragmentary, left side elevational view of the tool assembly of FIG. 1.
Figure 3:
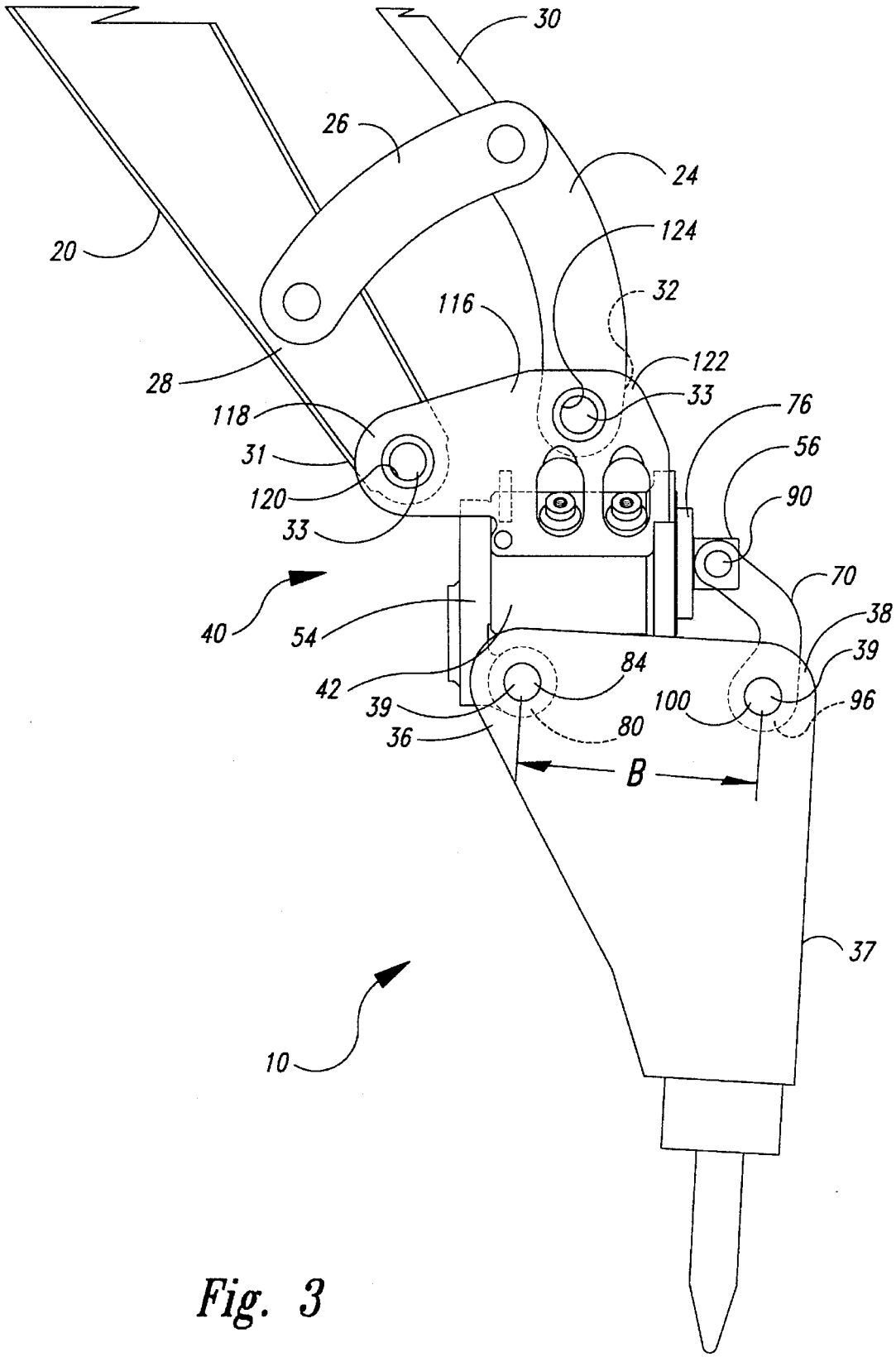
FIG. 3 is an enlarged, fragmentary, left side elevational view of an alternative tool in place of the tool of FIG. 1 with the alternative tool having a mounting hole spacing greater than the mounting hole spacing of the bucket.

In the illustrated embodiment of the invention, a conventional tool 34 is shown utilized in FIGS. 1 and 2. The tool has a toothed forward working edge 35 extending laterally, generally transverse to the forward rotation plane of the tool. The tool 34 further includes a first clevis 36 located toward the bucket working edge 35 and a second clevis 38 located rearwardly away from the first clevis. The first and second clevises 36 and 38 are in general parallel alignment with the forward rotation plane of the tool 34. It should be understood that the present invention may be practiced using other tools as work implements, and is not limited to just operation with buckets. For example, the bucket 34 could be replaced by a hydraulic breaker 37 such as shown in FIG. 3.

As illustrated in FIG. 2, mounting apertures 39 of the first and second clevises 36 and 38 are spaced apart at a fixed distance "A" from each other (measured from pin hole center to pin hole center). Sometimes it is necessary to change the tool attached to the vehicle 12, such as from the tool 34 of FIG. 2 to the hydraulic breaker 37 of FIG. 3. As illustrated in FIG. 3, the mounting apertures 39 of the first and second clevises 36 and 38 of the breaker 37 are spaced apart at a fixed distance "B" from each other, where the distance "B" is larger than the distance "A". As will be described in greater detail below, the present invention can easily accommodate varying distances between mounting apertures 39 of the first and second clevises 36 and 38 of different tools. The present invention advantageously allows the owner of the vehicle 12 to easily and quickly switch from one tool having one distance between its mounting apertures 39 of the first and second clevises 36 and 38 to another tool having a different distance between its mounting apertures.

Figure 4:
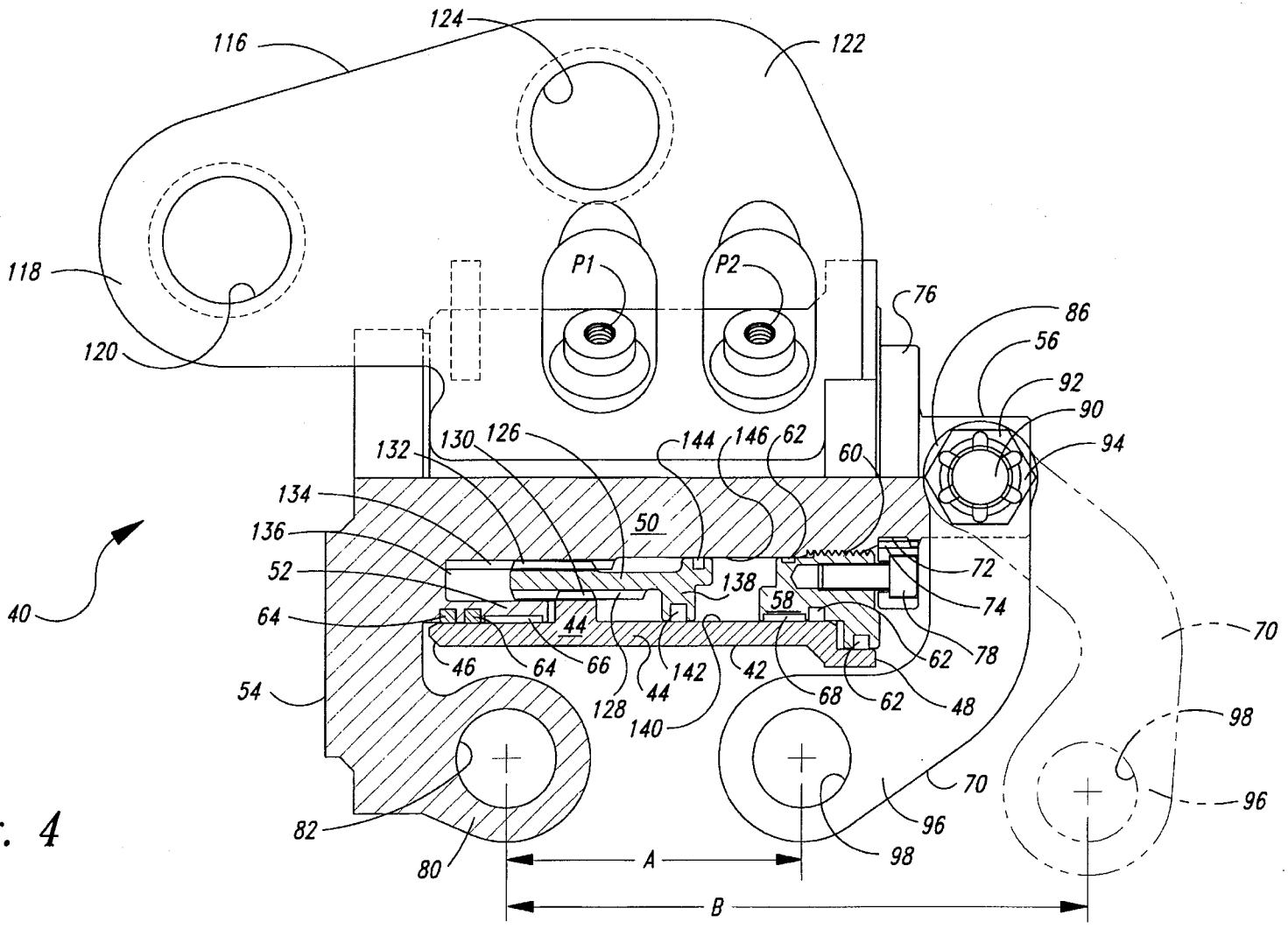
FIG. 4 is an enlarged, left side elevational view of the tool assembly of FIG. 1 shown in partial cross-section taken substantially along the line of 4—4 of FIG. 5.

The tool assembly 10 of the present invention further includes a rotary actuator 40. The actuator 40 of the first described embodiment of the invention is best shown in FIG. 4 and has an elongated housing or body 42 with a cylindrical sidewall 44 and first and second ends 46 and 48, respectively. An elongated rotary drive or output shaft 50 is coaxially positioned within the body 42 and supported for rotation relative to the body.

The shaft 50 extends the full length of the body 42, and has an interior flange portion 52 at the first body end 46, and an exteriorly extending attachment flange portion 54 extending exterior of the body at the first body end. The shaft 50 has an extending shaft portion 56 extending beyond and exterior of the body 42 at the second body end 48. The shaft 50 has an annular carrier or shaft nut 58 threadably attached thereto at the second body end 48. The shaft nut 58 has a threaded interior portion threadably attached to a correspondingly threaded perimeter portion 60 of the shaft 50 and the shaft nut rotates with the shaft. The shaft nut 58 is locked in place against rotation relative to the shaft 50 in a manner that will be described below. Seals 62 are disposed between the shaft nut 58 and the shaft 50, and between the shaft nut and the body sidewall 44 to provide a fluid-tight seal therebetween. Seals 64 are disposed between the interior shaft flange portion 52 and the body sidewall 44 to provide a fluid-tight seal therebetween. A radial bearing 66 is disposed between the interior shaft flange portion 52 and the body sidewall 44, and a radial bearing 68 is disposed between the shaft nut 58 and the body sidewall 44 to support the shaft 50 against radial thrust loads.

As will be described in detail below, a pair of laterally spaced apart, adjustably positionable attachment swing arms or members 70 are pivotally attached to the exteriorly extending shaft portion 56 to permit the easy attachment of the bucket 34, the breaker 37 or any other tool having mounting apertures 39 with differing pin hole center spacings. The extending shaft portion 56 has a splined portion 72 with straight, longitudinally extending splines which extend within and engage straight splines of a correspondingly splined central aperture 74 of a splined locking ring 76 positioned adjacent to the shaft nut 58. Preferably, the locking ring 76 rotates with the shaft 50. The shaft nut 58 has circumferentially arranged threaded apertures that each threadably receive bolt 78 to releasably secure the splined locking ring 76 to the shaft nut to insure the shaft nut will rotate in unison with the shaft 50 and not detach therefrom.

The attachment flange portion 54 is positioned outward of the body 42 at the first body end 46 and is fixedly formed as an integral part of the shaft 50 for rotation with the shaft relative to the body 42. The attachment flange portion 54 transmits the rotational drive of the shaft 50 to provide the torque needed for tilting the bucket 34 or the breaker 37 to the desired lateral tilt angle and for holding the tool/breaker in that position while the tool/breaker performs the desired work. The attachment flange portion 54 does not move axially relative to the body 42.

The attachment flange portion 54 extends radially beyond the body sidewall 44 and projects downwardly toward the bucket 34/breaker 37, and terminates in an attachment flange 80 comprising a pair of laterally spaced-apart flange arm-end portions, each with a mounting aperture 82 sized and positioned for mating with the mounting apertures 39 of the first clevis 36 and for attachment of the bucket 34 or breaker 37 to the actuator at a position therebelow using a selectively removable attachment pin 84 (see FIGS. 2 and 3).

Figure 5:
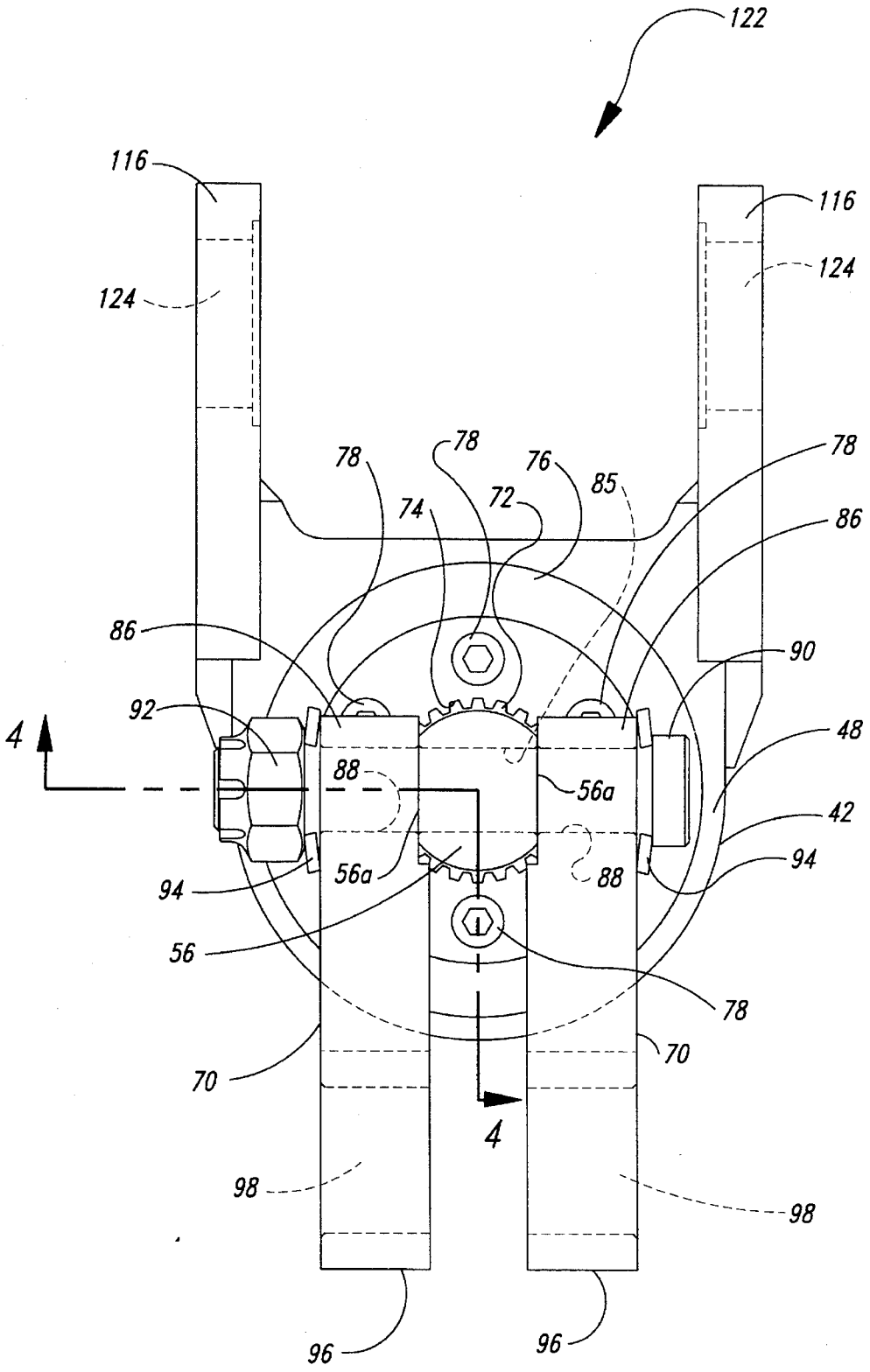
FIG. 5 is a fragmentary, rear elevational view of the tool assembly of FIG. 4.

As seen in FIG. 5, the exteriorly extending shaft portion 56 of the shaft 50 is machined flat on two opposite sides 56a in parallel planar alignment with the attachment flange 80 of the attachment flange portion 54. A transverse aperture 85 extends fully through the exteriorly extending shaft portion 56, perpendicular to the flat sides **56*a* thereof. One of the pair of adjustably positionable attachment members 70 is positioned with a first end portion 86 thereof at each of the flat sides 56*a*. The first end portion 86 of each of the adjustably positionable attachment members 70 has an aperture 88 positioned in coaxial alignment with the shaft aperture 85 and a bolt 90 pivotally attaches each adjustably positionable attachment member directly to the shaft 50. A lock nut 92 prevents removal of the bolt 90 during use of the tool assembly 10. A pair of spring washers 94 are also mounted on the bolt 90 one to the laterally outward side of each of the adjustably positionable attachment members 70. The adjustably positionable attachment members 70 are free to rotate about the longitudinal axis of the bolt 90**.

The adjustably positionable attachment members 70 each terminate in a second free-end portion 96 to define a pair of laterally spaced apart free-end portions, each with a mounting aperture 98 sized for mating with the mounting apertures 39 of the second tool clevis 38 and for attachment of the bucket 34 or breaker 37 to the actuator 40 at a position therebelow using a selectively removable attachment pin 100 (see FIGS. 2 and 3). In this embodiment the shaft 50 delivers rotational drive to the bucket 34 or breaker 37 through both the exteriorly extending attachment flange portion 54 at the first body end 46 and the exteriorly extending shaft portion 56 at the second body end 48.

When it is necessary to change tools, such as between the bucket 34 of FIG. 2 and the breaker 37 of FIG. 3, the adjustably positionable attachment members 70 need only be pivoted by hand to a position with their mounting apertures 98 spaced from the mounting apertures 82 of the attachment flange clevis 80 by an amount corresponding to the center hole spacing of the apertures 39 of the first and second clevises 36 and 38, for the new tool being attached. The adjustment is quick and simple.

As noted above, the adjustably positionable attachment members 70 are free to pivot about the longitudinal axis of the bolt 90, shown in FIG. 4 in solid line pivoted so as to be at a distance "A" from the attachment flange 80 of the attachment flange portion 54, using a pin hole center to pin hole center measurement. This corresponds to the mounting aperture spacing of the first and second clevises 36 and 38 of the bucket 34 (see FIG. 2). The adjustably positionable attachment members 70 may be pivoted about as necessary within its range of rotation about the bolt 90 to position the free-end portion 96 thereof at a selected distance from the attachment flange 80 which corresponds to the mounting aperture spacing of the tool next being attached to the shaft 50. In FIG. 4 the adjustably positionable attachment members 70 are shown in phantom line pivoted so as to be at a distance "B" from the attachment flange 80 corresponding to the mounting aperture spacing of the first and second clevises 36 and 38 of the breaker 37 (see FIG. 3).

Figure 6:
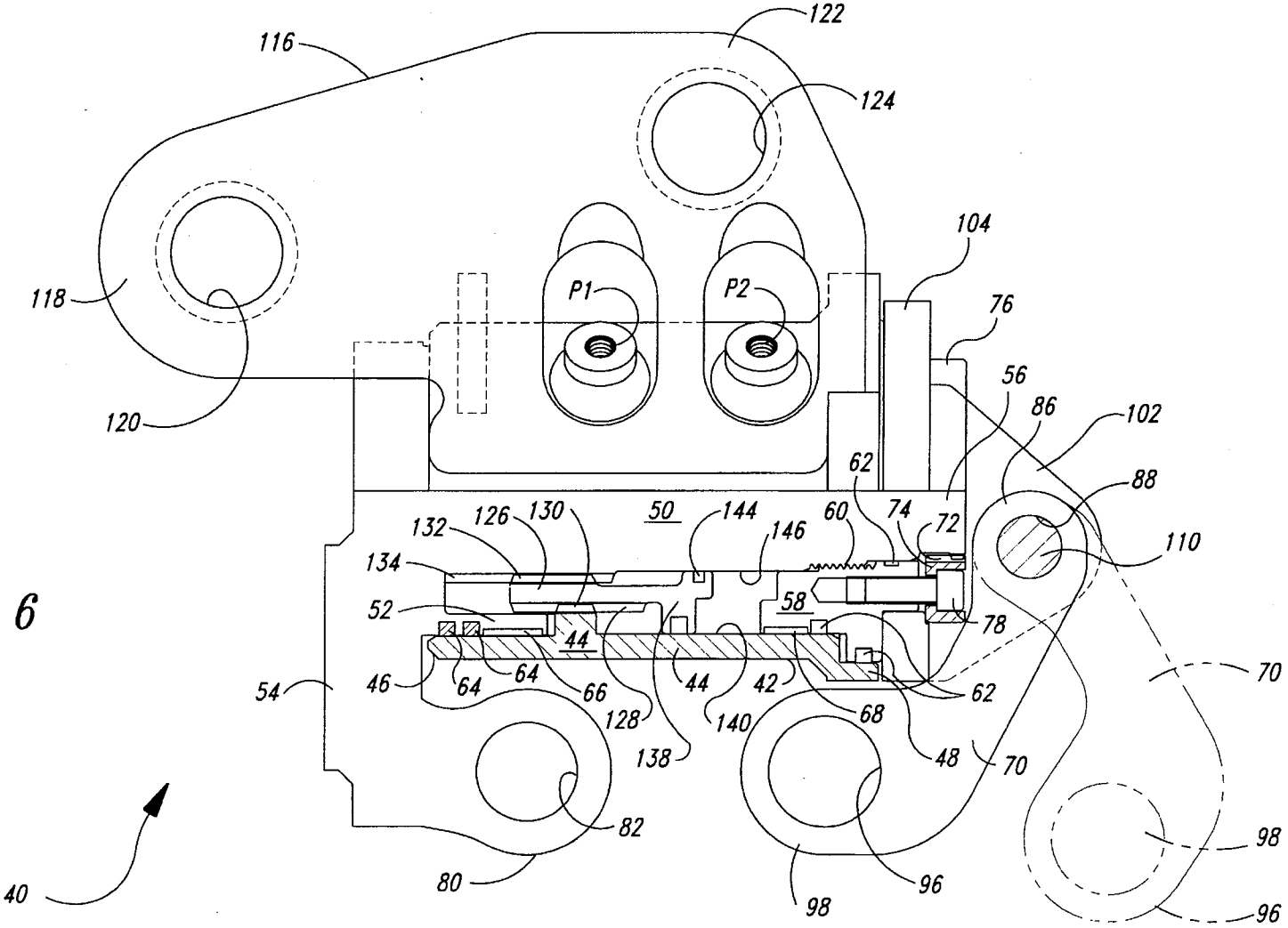
FIG. 6 is an enlarged, left side elevational view of an alternative embodiment of the tool assembly of FIG. 1 shown in partial cross-section taken substantially along the line of 6—6 of FIG. 7.
Figure 7:
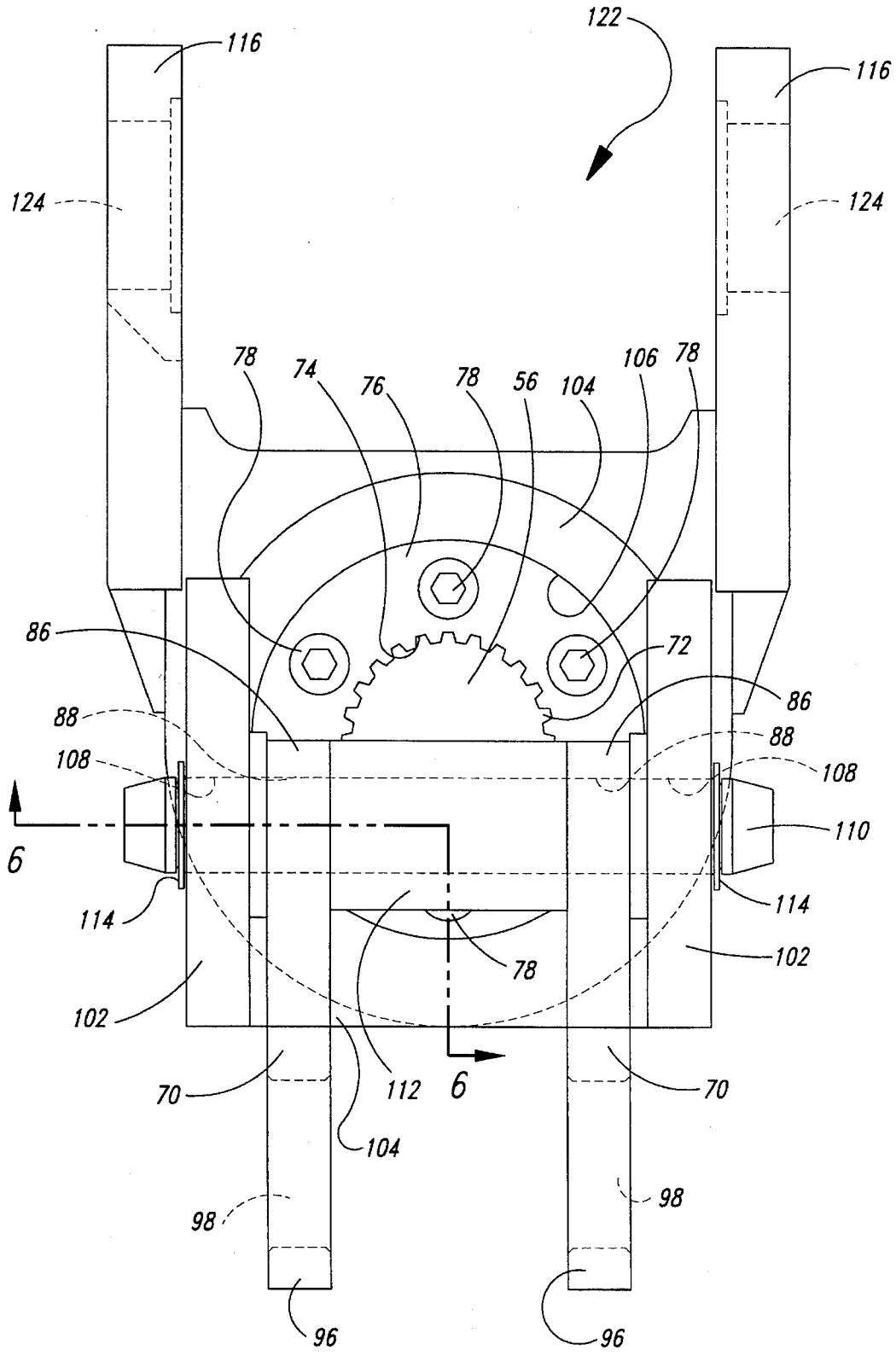
FIG. 7 is a fragmentary, rear elevational view of the alternative embodiment of the tool assembly of FIG. 6.

In an alternative embodiment, shown in FIGS. 6 and 7, the adjustably positionable attachment members 70 are pivotally attached to the shaft 50 by a pair of spaced apart support flanges 102 positioned outward of the body 42 at the second body end 48. The support flanges 102 are fixedly attached to a base plate 104 having a central aperture 106. The base plate 104 is positioned exterior of the body 42 at the second body end 48, between the shaft nut 58 and the splined locking ring 76, with the extending shaft portion 56 extending through the plate's central aperture 106. The central aperture 106 is sized sufficiently large to permit the base plate 104 to freely rotate relative to the extending shaft portion 56 within at least a rotational range needed to permit angular adjustment of the base plate relative to the shaft 50 during adjustment of the tool assembly 10 prior to use. The central aperture 106 of the base plate 104 is sufficiently large to avoid interference with the bolts 78 that secure the splined locking ring 76 to the shaft nut 58, but the splined locking ring is sufficiently large to overlay the interior periphery of the base plate around its central aperture. This allows the splined locking ring 76 to clamp the base plate 104 securely between the shaft nut 58 and the splined locking ring for rotation with the shaft 50 relative to the body 42 during use of the tool assembly 10.

Each of the support flanges 102 has a mounting hole 108 coaxially aligned with the mounting hole in the other support flange and sized to receive a pivot pin 110. As best seen in FIG. 7, each of the pair of adjustably positionable attachment members 70 is positioned with its first end portion 86 at a laterally inward side of one of the support flanges 102. The aperture 88 of the first end portion 86 of each of the adjustably positionable attachment members 70 is arranged in coaxial alignment with the mounting holes 108 of the support flanges 102 and the pivot pin 110 passes therethrough to pivotally mount the adjustably positionable attachment members to the shaft 50. A tubular spacer 112 is positioned on the pivot pin 110 between the adjustably positionable attachment members 70 and is sized to maintain their lateral separation. A C-clamp 114 is mounted in a groove at each end of the pivot pin 110, laterally outward of a corresponding one of the support flanges 102, to hold the pivot pin in position with respect to the support flanges.

In this alternative embodiment of the actuator 40, the base plate 104 is frictionally captured when clamped between the shaft nut 58 and the splined lock ring 76 to transmit limited rotational drive between the shaft 50 and the support flanges 102 and hence to the adjustably positionable attachment members 70. While some rotational drive is delivered to the support flanges 102 by this clamping, the primary source of the rotational drive provided by the shaft 50 to the bucket 34 or breaker 37 is through the attachment flange portion 54 as previously described for the first described embodiment. The amount of rotational drive supplied through the clamping is preferably sufficient to rotate the support flanges 102 with the shaft 50 when no tool is mounted to the actuator 40 such as when a user is operating the actuator by rotating the shaft in order to align the attachment flange 80 and the adjustably positionable attachment members 70 which rotate therewith, with the first and second clevises 36 and 38 for insertion of the attachment pins 84 and 100. It is noted that even with a tool mounted to the actuator 40 and with little or no clamping force applied by the splined locking ring 76, the support flange 102 will rotate as the shaft 50 rotates as a result of the rotational drive transmitted thereto through the attachment flange portion 54 via the bucket 34 or breaker 37 to which the attachment flange portion 54 and the adjustably positionable attachment members 70 are attached.

In operation, the movement of the rotation link 24 relative to the second arm 20 causes the bucket 34 or breaker 37 to be selectively rotated through the forward rotation plane. The entire tool assembly 10, and hence the tool, rotates about the attachment pin 33 of the second arm 20 as the rotation link 24 is moved relative to the second arm by the hydraulic cylinder 30. As will be described below, the body 42 of the actuator 40 is pivotally attached to the second arm 20 and the rotation link 24, much in the same manner as a conventional tool would be attached.

For purposes of illustration, the attachment of the bucket 34 to the attachment flange portion 54 and the adjustably positionable attachment members 70 for the embodiment of FIGS. 2-5 will be described with the tool being attached with its working edge 35 located toward the vehicle 12. It should be understood that the tool and most any other tool used with the actuator 40 can be reversed. The actuator 40 is operated to align the free-end portions of the attachment flange clevis 80 of the attachment flange portion 54 between the first clevis 36 with the mounting apertures 82 of the attachment flange in coaxial alignment with the mounting apertures 39 of the first clevis 36. The attachment pin 84 is then inserted through the coaxially aligned apertures. The free-end portions 96 of the adjustably positionable attachment members 70 are then positioned between the second clevis 38. The adjustably positionable attachment members 70 are each separately or together pivoted about the bolt 90 as necessary to move the mounting apertures 98 of the adjustably positionable attachment member 70 into coaxial alignment with the mounting apertures 39 of the second clevis 38. The attachment pin 100 is then inserted through the coaxially aligned apertures.

The ability to pivot the adjustably positionable attachment members 70 allows the use with tools having an indeterminate distance separating the mounting the apertures 39 of the first and second clevises 36 and 38 and for use with tools with varying mounting aperture spacings from tool to tool. The adjustably positionable attachment members 70 are provided with sufficient length so that their pivoting adjustment movement on the bolt 90 between their end limits of rotational travel produce a range of positions of the free-end portions 96 thereof, and hence their mounting apertures 98, which are spaced apart from the mounting apertures 82 of the attachment flange 80, sufficient to accommodate a variety of hole center spacings for the mounting apertures 39 of the first and second clevis 36 and 38 of tools. As such, easy and quick attachment of the actuator 40 to various size and styles of tools is achieved. To increase the range of positions possible, the adjustably positionable attachment members 70 have a bend in their midportion so that they may be pivoted to place their free-end portions 96 far under the body 42 of the actuator 40 and very close to the mounting apertures 82 of the attachment flange 80 to allow attachment to very closely spaced first and second clevis 36 and 38.

In the embodiment of FIGS. 6 and 7, the adjustably positionable attachment members 70 are initially placed in parallel planar alignment with the attachment flange 80 or as subsequently needed, by loosening the bolts 78 by which the splined locking ring 76 is secured to the shaft nut 58 until the base plate 104 can be rotated relative to the shaft 50 and then rotating the base plate to bring the support flanges 102 and the adjustably positionable attachment members into parallel planar alignment with the attachment flange 80. The bolts 78 are then tightened to clamp the base plate 104 so that it rotates with the shaft 50 and maintains this relationship when aligning the actuator 40 for attachment of a tool.

A pair of attachment brackets 116 is used to detachably connect the body 42 to the second arm 20 and the rotation link 24 in a position therebelow in general alignment with the forward rotation plane. The attachment brackets 116 are rigidly attached to the body sidewall 44. The attachment brackets 116 form a first attachment clevis 118 with an aperture 120 therein sized to receive one of the attachment pins 33 (see FIGS. 2 and 3) to pivotally connect the body 42 to the vehicle second arm 20 at its free end portion 31, and a second attachment clevis 122 with an aperture 124 therein sized to receive the other of the attachment pins 33 to pivotally connect the body to the rotation link 24 at its free end portion 32. By the use of selectively removable attachment pins 33, the tool assembly 10 can be quickly and conveniently removed from the second arm 20 and the rotation link 24 when use of the tool assembly is not desired.

The actuator 40 used with the tiltable tool assembly 10 of the present invention is a compact, fluid-powered rotary actuator with a design which requires little space. This allows the construction of a tiltable tool assembly for use with a very narrow width bucket or other tool. Furthermore, the tool assembly can be used with conventional buckets and tools, and thus can be retrofitted onto vehicles with existing tools without requiring purchase of a new tool.

As shown in FIGS. 4 and 6, an annular piston sleeve 126 is coaxially and reciprocally mounted within the body 42 coaxially about the shaft 50. The piston sleeve 126 has outer helical splines 128 over a portion of its length which mesh with inner helical splines 130 of a splined intermediate interior portion of the body sidewall 44. The piston sleeve 126 is also provided with inner helical splines 132 which mesh with outer helical splines 134 provided on a splined portion of the shaft 50 toward the first body end 46. The shaft flange portion 52 has a circumferentially extending recess 136 which opens facing toward the second body end 48 and is sized to receive a lengthwise portion of the splined piston sleeve 126 therein when it moves axially toward the first body end 46. It should be understood that while helical splines are shown in the drawings and described herein, the principle of the invention is equally applicable to any form of linear-to-rotary motion conversion means, such as balls or rollers.

In the illustrated embodiment of the invention, the piston sleeve 126 has an annular piston head 138 positioned toward the second body end 40 with the shaft 50 extending therethrough. The piston head 138 is slidably maintained within the body 42 for reciprocal movement, and undergoes longitudinal and rotational movement relative to a smooth interior wall surface 140 of the body sidewall 44, as will be described in more detail below.

A seal 142 is disposed between the piston head 138 and the interior wall surface 140 of the body-sidewall 44 to provide a fluid-tight seal therebetween. A seal 144 is disposed between the piston head 138 and a smooth exterior wall surface 146 of the shaft 50 to provide a fluid-tight seal therebetween.

As will be readily understood, reciprocation of the piston head 138 within the body 42 occurs when hydraulic oil, air or any other suitable fluid under pressure selectively enters through one or the other of a first port P1 which is in fluid communication with a fluid-tight compartment within the body to a side of the piston head toward the first body end 46 or through a second port P2 which is in fluid communication with a fluid-tight compartment within the body to a side of the piston head toward the second body end 48. As the piston head 138 and the piston sleeve 126, of which the piston head is a part, linearly reciprocates in an axial direction within the body 40, the outer helical splines 128 of the piston sleeve engage or mesh with the inner helical splines 130 of the body sidewall 44 to cause rotation of the piston sleeve. The linear and rotational movement of the piston sleeve 126 is transmitted through the inner helical splines 132 of the piston sleeve to the outer helical splines 134 of the shaft 50 to cause the shaft to rotate. The smooth wall surface 146 of the shaft 50 and the smooth wall surface 140 of the body sidewall 44 have sufficient axial length to accommodate the full end-to-end reciprocating stroke travel of the piston sleeve 126 within the body 42. Longitudinal movement of the shaft 50 is restricted, thus all movement of the piston sleeve 126 is converted into rotational movement of the shaft 50. Depending on the slope and direction of turn of the various helical splines, there may be provided a multiplication of the rotary output of the shaft 50.

The application of fluid pressure to the first port P1 produces axial movement of the piston sleeve 126 toward the second body end 48. The application of fluid pressure to the second port P2 produces axial movement of the piston sleeve 126 toward the body first end 46. The actuator 40 provides relative rotational movement between the body 42 and shaft 50 through the conversion of linear movement of the piston sleeve 126 into rotational movement of the shaft, in a manner well known in the art. The shaft 50 is selectively rotated by the application of fluid pressure, and the rotation is transmitted to the bucket 34, breaker 37 or other tool attached thereto through the attachment flange portion 54 and the adjustably positionable attachment members 70 to selectively tilt the tool laterally, left and right.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered laterally tiltable bucket assembly, usable with a vehicle having an arm and a rotation link associated therewith for rotation of the bucket assembly in a first plane defined by movement of the rotation link relative to the arm, each of the arm and rotation link having an attachment member located toward a free end thereof, the bucket assembly comprising:

one of a plurality of buckets, each having a working edge extending laterally, generally transverse to the first plane, a first bucket attachment member and a second bucket attachment member located away from said first bucket attachment member where the distance between said first and second bucket attachment members varies from bucket to bucket within a range of bucket attachment member distances;

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached to the arm and rotation link attachment members, movement of the rotation link causes said body to rotate about the vehicle arm with movement of said longitudinal axis of said body in generally parallel alignment with the first plane, and wherein the bucket assembly is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member attached thereto which is releasably attachable to said first bucket attachment member;

a member pivotally attached to said second shaft end portion to pivot about an axis generally transverse to said second shaft end portion, said pivotable member having a second shaft attachment member attached thereto which is releasably attachable to said second bucket attachment member, said pivotable member being selectively pivotable to move said second shaft attachment member within a range of distances corresponding to said range of bucket attachment member distances and position said second shaft attachment member at a selected distance from said first shaft attachment members such that said first and second shaft attachment members are spaced apart by the same distance as said first and second bucket attachment members for said bucket being attached to said shaft, said first and second shaft attachment members releasably attaching said bucket to said shaft for rotation with said shaft through a second plane extending laterally, generally transverse to the first plane; and a linear-to-rotary torque transmitting member mounted for longitudinal movement within said body in response to selective application of pressurized fluid thereto, said torque-transmitting member engaging said body and said shaft to translate longitudinal movement of said torque-transmitting member into rotational movement of said shaft relative to said body, whereby said bucket attached to said shaft is rotatable in the first plane and laterally tiltable in the second plane.

2. The bucket assembly of claim 1 wherein said second shaft end portion extends beyond said body second end and has an aperture extending therethrough and receiving a pivot pin by which said pivotable member is pivotally attached to said second shaft end portion.

3. The bucket assembly of claim 1, further including a mounting flange mounted to said second shaft end portion for rotation with said shaft, said pivotable member being pivotally attached to said mounting flange.

4. The bucket assembly of claim 3 wherein said mounting flange is releasably clamped to said second shaft end portion, and said mounting flange when released is rotatable about said second shaft end portion to adjustably select the rotational position of said mounting flange relative to said second shaft end portion and when clamped rotates with said second shaft end portion.

5. The bucket assembly of claim 1 wherein said pivotable member has a first end portion pivotally attached to said second shaft portion and a second end portion spaced apart therefrom forming said second attachment member.

6. The bucket assembly of claim 5 wherein said first end portion of said pivotable member extends away from said second shaft portion a sufficient distance to allow positioning of said second end portion of said pivotable member projects below said body when said pivotable member is pivoted to move said second end portion thereof toward said first body end, said second end portion of said pivotable member when in said position projects below said body in a direction toward said first body end.

7. The bucket assembly of claim 1 wherein said pivotable member includes a pair of laterally spaced apart swing arms, each with a first end portion pivotally attached to said second shaft end portion and a second end portion forming a part of said second shaft attachment member.

8. The bucket assembly of claim 1 wherein said first shaft attachment member includes a pair of laterally spaced apart attachment arms fixedly attached to said first shaft end portion and said second shaft attachment member includes a pair of laterally spaced apart attachment arms pivotally attached to said second shaft end portion, and wherein said first and second bucket attachment members each comprise a clevis and includes a laterally extending pin, each pin being positioned to be engaged and retained by a correspondingly positioned one of said pairs of attachment arms for rotation and lateral tilting of said bucket.

9. A fluid-powered tool actuator, usable with a vehicle having an arm and a rotation link associated therewith for rotation of the tool actuator in a first plane defined by movement of the rotation link relative to the arm, each of the arm and rotation link having an attachment member located toward a free end thereof, and usable with a plurality of tools each having a first tool attachment member and a second tool attachment member located away from the first tool attachment member where the distance between the first and second tool attachment members varies from tool to tool within a range of tool attachment member distances, the tool actuator comprising:

a body having a longitudinal axis and first and second ends;

an attachment bracket rigidly attached to said body and having an external first bracket attachment member located generally along said body axis for pivotal attachment to the vehicle arm by the arm attachment member and an external second bracket attachment member located generally along said body axis away from said first bracket attachment member for pivotal attachment to the rotation link by the rotation link attachment member, said first and second bracket attachment members being selectively detachable from the arm and rotation link attachment members, wherein with said first and second bracket attachment members attached to the arm and rotation link attachment members, movement of the rotation link causes said body to rotate about the vehicle arm with movement of said longitudinal axis of said body in generally parallel alignment with the first plane, and wherein the tool actuator is selectively detachable from the vehicle arm and rotation link;

an output shaft rotatably disposed within said body in general coaxial arrangement with said body and having a first shaft end portion extending at least to said first body end and a second shaft end portion extending toward said second body end, said first shaft end portion having a first shaft attachment member attached thereto which is releasably attachable to the first tool attachment member;

a member pivotally attached to said second shaft end portion to pivot about an axis generally transverse to said second shaft end portion, said pivotable member having a second shaft attachment member attached thereto which is releasably attachable to the second tool attachment member, said pivotable member being selectively pivotable to move said second shaft attachment member within a range of distances corresponding to the range of tool attachment member distances and position said second shaft attachment member at a selected distance from said first shaft attachment member such that said first and second shaft attachment members are spaced apart by the same distance as the first and second tool attachment members for the tool being attached to said shaft, said first and second shaft attachment members releasably attaching the tool to said shaft for rotation with said shaft through a second plane extending laterally, generally transverse to the first plane; and a linear-to-rotary torque transmitting member mounted for longitudinal movement within said body in response to selective application of pressurized fluid thereto, said torque-transmitting member engaging said body and said shaft to translate longitudinal movement of said torque-transmitting member into rotational movement of said shaft relative to said body, whereby the tool attached to said shaft is rotatable in the first plane and laterally tiltable in the second plane.

10. The tool actuator of claim 9 wherein said second shaft end portion extends beyond said body second end and has an aperture extending therethrough and receiving a pivot pin by which said pivotable member is pivotally attached to said second shaft end portion.

11. The tool actuator of claim 9, further including a mounting flange mounted to said second shaft end portion for rotation with said shaft, said pivotable member being pivotally attached to said mounting flange.

12. The tool actuator of claim 11 wherein said mounting flange is releasably clamped to said second shaft end portion, and said mounting flange when released is rotatable about said second shaft end portion to adjustably select the rotational position of said mounting flange relative to said second shaft end portion and when clamped rotates with said second shaft end portion.

13. The tool actuator of claim 9 wherein said pivotable member has a first end portion pivotally attached to said second shaft portion and a second end portion spaced apart therefrom forming said second attachment member.

14. The tool actuator of claim 13 wherein said first end portion of said pivotable member extends away from said second shaft portion a sufficient distance to allow positioning of said second end portion of said pivotable member projects below said body when said pivotable member is pivoted to move said second end portion thereof toward said first body end, second end portion of said pivotable member when in said position projects below said body in a direction toward said first body end.

15. The tool actuator of claim 9 wherein said pivotable member includes a pair of laterally spaced apart swing arms, each with a first end portion pivotally attached to said second shaft end portion and a second end portion forming a part of said second shaft attachment member.

16. The tool actuator of claim 9 wherein said first shaft attachment member includes a pair of laterally spaced apart attachment arms fixedly attached to said first shaft end portion and said second shaft attachment member includes a pair of laterally spaced apart attachment arms pivotally attached to said second shaft end portion, and wherein the first and second tool attachment members each comprise a clevis and includes a laterally extending pin, each pin being positioned to be engaged and retained by a correspondingly positioned one of said pairs of attachment arms for rotation and lateral tilting of the tool.

* * * * *